United States Patent [19]

TrUMLu tzschler

[11] 4,219,289

[45] Aug. 26, 1980

[54] ARRANGEMENT FOR LOADING A CARD

[75] Inventor: Hermann Trützschler, Mönchengladbach, Fed. Rep. of Germany

[73] Assignee: Trützschler GmbH & Co. Kg., Mönchengladbach, Fed. Rep. of Germany

[21] Appl. No.: 8,704

[22] Filed: Jan. 31, 1979

[30] Foreign Application Priority Data

Feb. 2, 1978 [DE] Fed. Rep. of Germany ..... 2804413

[51] Int. Cl.[2] ..... B65G 53/40

[52] U.S. Cl. ..... 406/70; 19/105; 406/106

[58] Field of Search ..... 19/105; 406/70, 156, 406/106

[56] References Cited

U.S. PATENT DOCUMENTS

| | | | |
|---|---|---|---|
| 3,708,210 | 1/1973 | Stahel et al. | 406/70 |
| 3,728,759 | 4/1973 | Hergath | 406/70 |
| 4,045,091 | 8/1977 | Beneke | 406/156 |
| 4,085,977 | 4/1978 | Varga | 406/156 |
| 4,136,911 | 1/1979 | Husges et al. | 406/70 |

*Primary Examiner*—Robert W. Saifer
*Assistant Examiner*—Gene A. Church
*Attorney, Agent, or Firm*—Haseltine, Lake & Waters

[57] ABSTRACT

An arrangement for supplying a card by means of a feed chute to which the fiber material is supplied from above and from which it is removed below for delivery to the card. The feed chute for compressing fiber material has at its lower end air exit openings and at its upper end an arrangement delivering flowing air fiber material. The air exiting from the air exit openings is drawn in and fed again to the feed chute at its upper end. One end of an outflow channel is connected to the air exit openings and the other end to a unit delivering air to the fiber material. This unit may be capable of generating flowing air in spurts or continuously. It may be a check-valve type pump or a fan. A filter device is located in the outflow channel, and an air distribution arrangement may be placed behind the unit for delivering air.

12 Claims, 1 Drawing Figure

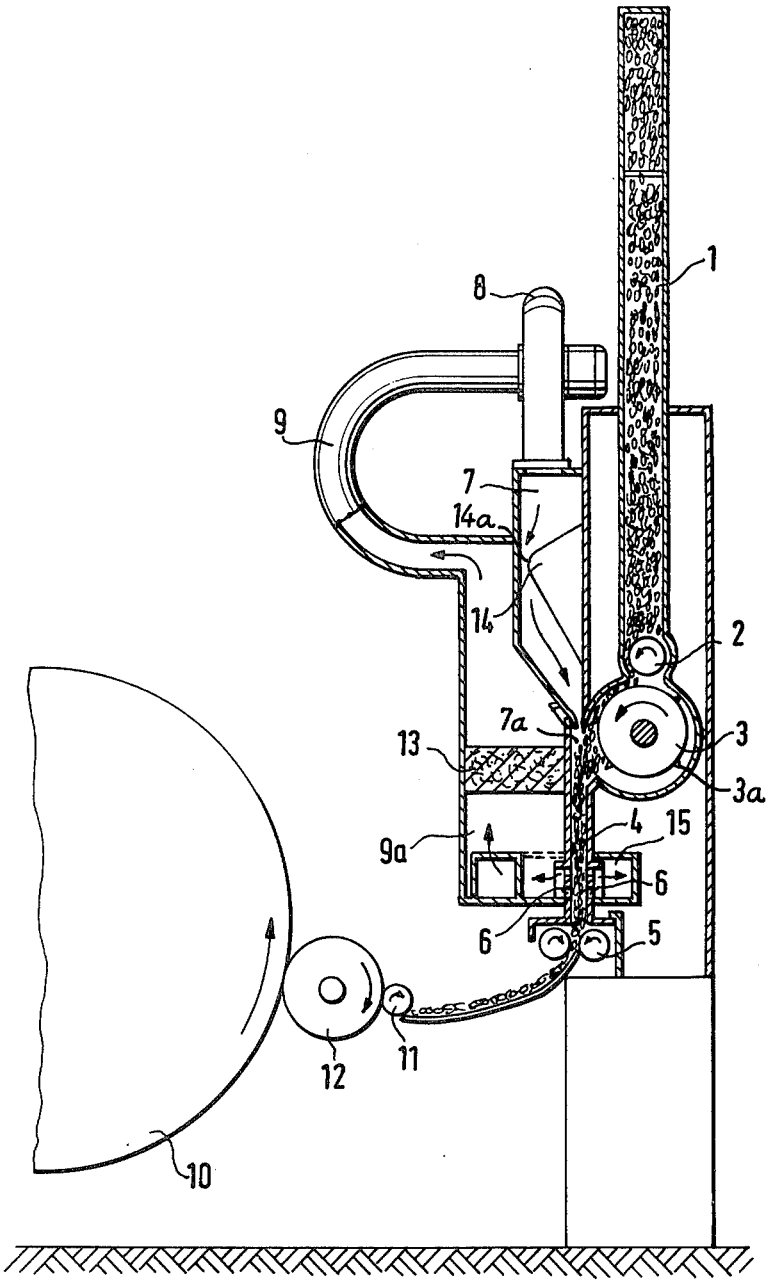
1
8
9
7
14a
14
2
7a
3
13
3a
4
15
9a
6
6
5
12
11
10

ARRANGEMENT FOR LOADING A CARD

BACKGROUND OF THE INVENTION

The present invention relates to a method for loading a card by means of a feed chute to which the fiber material is supplied from above and from which it is taken at the bottom for delivery to the card; the feed chute is equipped at its bottom end with air discharge openings for compressing the fiber material and has at its upper end an arrangement for applying the fiber material with air to flow through the material.

With a known method, the walls of the feed chute are equipped at their lower portion with air discharge openings up to a certain height. In order to compress the flock fill uniformly inside the feed chute, air is forced through the fiber mass in the feed chute, with the air exiting from the openings at the lower end of the feed chute. The dust picked up from the flock fill enters freely the spinning room.

Accordingly, it is an object of the present invention to provide an arrangement free from the above-mentioned disadvantages, and which prevents the dust picked up from the flock fill, from freely entering the spinning room.

Another object of the present invention is to provide an arrangement of the foregoing character which is substantially simple in construction and may be economically fabricated.

A further object of the present invention is to provide an arrangement for loading a card, as described, which may be readily maintained in service and which has a substantially long operating life.

SUMMARY OF THE INVENTION

The present invention is based on the concept to provide a closed cycle by feeding the air, which exits at the lower end of the chute through the air exit openings, back to the suction intake of the check-valve type pump, the fan, etc. This prevents the dust-laden air from entering the spinning room. This method meets the requirement for lowering the maximum dust concentration in spinning mills. The method has the additional advantage that the check-valve type pump, fan, etc. not only applies air to the fiber material, but also removes it from the air exit openings. In practice it has been found that the amount of dust exiting from the air exit openings is very small in comparison to the amount of dust present in the flocks in the feed chute. For this reason, feeding this small amount back to the feed chute is not significant. However, in contrast thereto, the dust exiting from the air exit openings adds up in the course of time to a considerable amount of dust in the spinning room, so that the advantage of keeping the air in the spinning room clean by far outweighs this consideration. The method in accordance with the present invention has combined the maintenance of air cleanliness with the suction of the air exit openings in a very simple manner.

The present invention also includes an apparatus for carrying out the method in accordance with the present invention. In this apparatus, there is connected to the air exit openings an outflow channel with its one end, whose other end is connected to the apparatus which applies air to the fiber material.

The arrangement blowing air at the fiber material can advantageously generate air in spurts, for example, via a pump or a revolving perforated disk. The arrangement can produce a continuous air current, for example, via a fan. The fan is of simple construction and rarely susceptible to trouble.

In order to prevent the dust which exits from the air exit openings, from returning to the flock fill, a filtering device is located in the outflow channel in a preferred embodiment.

Furthermore, it is expedient that the device blowing air at the fiber material is followed by an air distribution device. This accomplishes that the air exiting from the fan, pump, etc. is directed in such a way that the fiber material receives air uniformly distributed over the width of the feed chute.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWING

An elevational front view showing the essential elements and their cooperative relationships, in accordance with the present invention.

DESCRIPTION OF THE PREFERRED EMBODIMENTS

In front of the card 10 is a vertical spare chute 1 which can be loaded from the top with finely broken-up fiber material. The loading may be made pneumatically via a condenser through a delivery and distributor conduit. The lower end of the spare chute 1 is closed by a feed roller 2. This feed roller 2 delivers the fiber material from the spare chute to an opening roller 3 underneath, equipped with spikes 3*a* or sawtooth wire. Along part of its circumference, this opening roller 3 is connected with a second chute which is identified as feed chute 4. The opening roller 3, revolving in the direction of the arrow, delivers the fiber material or seized or grasped by it to the feed chute 4. The feed chute 4 on its lower end has two removal rollers 5 revolving as indicated by the arrows which deliver the fiber material via a feed cylinder 11 and a tearup device 12 to the card.

The walls of the feed chute 4 have air exit openings 6 in the lower portion up to a certain height. On top, the feed chute 4 terminates in a box-shaped space or chamber 7 whose upper end is connected to the output of a fan 8. Through the rotating feed roller 2 and the rotating opening roller 3, a constant quantity of fiber material per unit time is delivered to the feed chute 4 and an equal quantity of fiber material is removed by the removal rollers 5 from the feed chute 4 and delivered to the card 10. In order to compress this quantity uniformly and to keep it constant, the fan 8 via the box-shaped space 7 delivers air flow to the fiber material via a restriction 7*a* of, for example, 8 mm placed at the lower end of the box-shaped space. In the fan 8, air is drawn from the outflow channel 9 and forced through the fiber mass located in feed chute 4. The air exits from the air exit openings 6 at the lower end of the feed chute. These air exit openings 6 are connected to one end 9*a* of outflow channel 9 whose other end is connected to the fan 8 supplying air to the fiber material. The air exit opening 6 facing away from end 9*a* is connected via a connecting channel 15 to the end 9*a*. The outflow channel 9 contains a filtering device 13 in order to remove dust from the dust-laden air flowing from the air exits openings 6. Inside the box-shaped space or chamber 7 is an air distribution device 14 which extends over the entire width of the box-shaped space 7. This air distribution device 14 restricts the box-shaped space 7 in such a way that between one sidewall of the box-shaped space 7 and the air distribution device 14 a gap 14*a* of about 8 mm appears. The air distribution device 14 projects into the box-shaped space 7, with the flank facing the fan forming an angle of, for example, 30° with the normal, while the flank facing the feed chute 4 makes an angle of, for example, about 60° with the normal. As a result, the air current exiting from fan 8 is first backed-up in the box-shaped space, then passes through the narrow gap and finally acts, with uniform distribution, over the entire width on the flock fill present in the feed chute 4, and flows through this flock fill. The projection of unit 14 is advantageously rounded off in the region of this small gap.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following claims.

What is claimed is:

1. A method for supplying a card by means of a feed chute, comprising the steps of: supplying fiber material from above; compressing the fiber material; removing fiber material from below; delivering fiber material to said card; delivering air flow to fiber material at an upper end of said feed chute; drawing in air exiting from air exit openings at a lower end of said feed chute; feeding air to said upper end of said feed chute through a restriction backing up the air at first and then distributing the air uniformly over the entire width of fiber material present in said feed chute after passing through said restriction, the uniformly distributed air flowing through said fiber material in said chute.

2. An apparatus for supplying a card by means of a feed chute, comprising: means for supplying fiber material from above; means for compressing fiber material; means for removing fiber material from below for delivery to said card; means for delivering air to fiber material at an upper end of said feed chute; an outflow channel drawing air from exit openings at lower end of said feed chute and connected to said means for delivering air to fiber material at the upper end of said feed chute; chamber means connected between an output of said air delivering means and an upper end of said feed chute; air distributing means in said chamber means and restricting the interior space of said chamber means by forming a gap between one sidewall of said chamber means and said air distributing means, air exiting from said air delivering means being first backed-up in said chamber means and then passed through said gap for being uniformly distributed over the entire width of fiber material present in said feed chute and flowing through said fiber material in said chute.

3. An apparatus as defined in claim 2 wherein said means for delivering air can generate flowing air in spurts.

4. An apparatus as defined in claim 2 wherein said means for delivering air is a check-valve type pump.

5. An apparatus as defined in claim 2 wherein said means for delivering air can generate a continuous air current.

6. An apparatus as defined in claim 2 wherein said means for delivering air is a fan.

7. An apparatus as defined in claim 2 including a filter device in said outflow channel.

8. An apparatus as defined in claim 2 including air distribution means located behind said means for delivering air.

9. An apparatus as defined in claim 2 wherein said air distributing means projects into said chamber means with a flank facing said air delivering means, said air delivering means comprising fan means, said flank forming an angle of substantially 30 degrees with a normal, the flank portion facing said feed chute forming an angle of substantially 60 degrees with a normal, said flanks forming a rounded-off projecting portion bordering said gap.

10. An apparatus as defined in claim 9 wherein said chamber means comprises a box-shaped chamber having a substantially large entrance portion at an upper end for entry of air from said fan means and having a substantially narrowed exit opening communicating with said feed chute; and filter means in an auxiliary chamber between said outflow channel and said air delivering means, said auxiliary chamber being partially bordered by said first-mentioned chamber means and said feed chute.

11. A method for supplying a card by means of a feed chute by two filling chambers, comprising the steps of: supplying fiber material to a reservoir chamber from above; compressing the fiber material; removing fiber material from a feed chamber from below; delivering fiber material to said card; delivering air flow to fiber material at an upper end of said feed chute; drawing in air exiting from air exit openings at a lower end of said feed chute; feeding air to said upper end of said feed chute; fiber material being removed from said reservoir chamber from below through at least one removal roller, fiber material being delivered to said feed chamber by an opening roller, said feed chamber being provided with said air exit openings and means at its upper end impinged by streaming air for compressing said fiber material, the improvement comprising drawing air from said feed chamber through said air exit openings and returning the air to said feed chamber at its upper end.

12. An apparatus for supplying a card by means of a feed chute by two filling chambers, comprising: means for supplying fiber material to a reservoir chamber from above; means for compressing fiber material; means for removing fiber material from a feed chamber from below for delivery to said card; means for delivering air to fiber material at an upper end of said feed chute; an outflow channel drawing air from exit openings at lower end of said feed chute and connected to said means for delivering air to fiber material at the upper end of said feed chute; fiber material being removed from said reservoir chamber from below through at least one removal roller, fiber material being delivered to said feed chamber by an opening roller, said feed chamber being provided with said air exit openings and means at its upper end impinged by streaming air for compressing said fiber material, the improvement comprising drawing air from said feed chamber through said air exit openings and returning the air to said feed chamber at its upper end.

* * * * *